United States Patent [19]

Follows

[11] 4,063,397

[45] Dec. 20, 1977

[54] BAR SPACER FOR REINFORCED CONCRETE

[75] Inventor: James Follows, Surrey, Canada

[73] Assignee: Vanguard Plastics Ltd., Canada

[21] Appl. No.: 739,643

[22] Filed: Nov. 8, 1976

[51] Int. Cl.[2] ..... E04C 5/16

[52] U.S. Cl. ..... 52/684; 52/687

[58] Field of Search ..... 52/677–689

[56] References Cited

U.S. PATENT DOCUMENTS 3,471,987 10/1969 Yelsma ..... 52/684

FOREIGN PATENT DOCUMENTS 1,573,010 5/1969 France ..... 52/684

2,338,983 2/1975 Germany ..... 52/687

904,766 8/1962 United Kingdom ..... 52/687

*Primary Examiner*—J. Karl Bell

*Attorney, Agent, or Firm*—Fetherstonhaugh & Co.

[57] ABSTRACT

A bar spacer for concrete reinforcing bars. The spacer comprises, a foot portion to contact a form for concrete. A bar gripping portion is adapted to grip reinforcing bar for concrete. A plurality of spaced teeth are formed on the internal surface of the bar gripping portion. The teeth are arranged so that each tooth is out of alignment with the tooth next to it whereby each tooth can bend to a position past its neighboring tooth. This ensures that each spacer can grip and locate bars of varying diameter.

2 Claims, 4 Drawing Figures

BAR SPACER FOR REINFORCED CONCRETE

FIELD OF THE INVENTION

This invention relates to a bar spacer for concrete reinforcing bars.

DESCRIPTION OF PRIOR ART

In pouring reinforced concrete it is necessary to ensure that the reinforcing retains a desired position. Typically the cross pieces are welded to the longitudinal pieces but it is also necessary to ensure that the reinforcement does not protrude through the surface of the poured concrete. Generally this is carried out by the use of a bar spacer. Bar spacers find particular application in the pouring of concrete columns. A bar spacer is fitted onto the reinforcing bar and is provided with feet that contact the shuttering or form for the poured concrete. The feet are spaced a short distance away from the bar gripping portion of the bar spacer so that it can be ensured that the reinforcing bars will remain within the concrete and will not be forced outwardly when the concrete is poured.

A disadvantage with prior art bar spacers is that they are useful only for restricted diameters of reinforcing bars. As it is common to use a fairly wide variety of reinforcing bars it has been the prior practice to use different bar spacers for the differing reinforcing bars.

However, attempts have been made to use bar spacers able to grip adequately a variety of diameters of bars but generally speaking, the variety remains limited.

SUMMARY OF INVENTION

The present invention seeks to provide a bar spacer for concrete reinforcing bars able to grip a wide variety of diameters of reinforcing bars.

In particular, the present invention is a bar spacer for concrete reinforcing bars comprising a foot portion to contact a form for concrete, a bar gripping portion adapted to grip a reinforcing bar for the concrete, a plurality of spaced teeth formed on the internal surface of the bar gripping portion, the teeth being arranged so that each tooth is out of alignment with the tooth next to it whereby each tooth can bend to a position past its neighbouring tooth so that each spacer can grip and locate bars of varying diameter.

In a preferred embodiment the bar spacer may be molded from high density polyethylene, a material that provides reasonable cost with reasonable strength.

BRIEF DESCRIPTION OF DRAWINGS

The invention is illustrated, merely by way of example, in the accompanying drawings, in which.

DESCRIPTION OF PREFERRED EMBODIMENT

Figure 1:
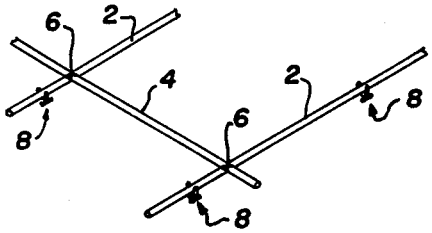
FIG. 1 is a general view of reinforcing bars located by the bar spacers according to the present invention.

In the drawings, FIG. 1 illustrates a reinforced bar system comprising longitudinal members 2 and cross members 4. The longitudinal members 2 and cross members 4 are located relative to each other by welding at the junctions 6. Bar spacers 8 are attached to the longitudinal members 2 and act to space the longitudinal members—and thus the cross members 4—from the wooden form typically used in concrete molding.

Figure 2:
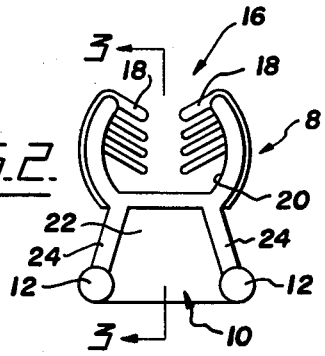
FIG. 2 is a front view of a bar spacer according to the invention.
Figure 3:
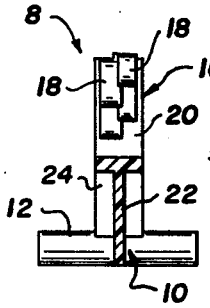
FIG. 3 is a section along the line 3—3 of FIG. 2
Figure 4:
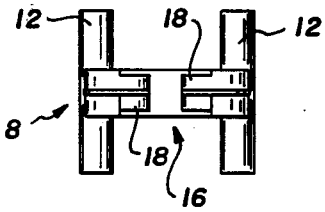
FIG. 4 is a plan view of the bar spacer shown in FIG. 2.

As illustrated in more detail in FIGS. 2 to 4, the bar spacers 8 comprise a base or foot portion 10 having feet 12. There is a bar gripping portion 16 which is adapted to grip a reinforcing bar (for example 2 or 4). There are a plurality of spaced teeth 18 formed on the internal surface 20 of the bar gripping portion 16. As is shown most clearly in FIGS. 3 and 4, spaced teeth 18 are arranged so that each tooth 18 is out of alignment with the tooth 18 next to it. The effect of this misalignment or staggering of the teeth 18 is to permit each tooth to bend to a position past its neighbouring tooth. This permits relatively large movement of the teeth 18 and thus the gripping of relatively large diameter reinforcing bars. For relatively small reinforcing bars the teeth 18 wll not be misplaced greatly. However, for larger diameter reinforcing bars the teeth 18 will be considerably bent, almost to the contacting the internal surface 20 of the bar gripping portion 16.

As indicated most clearly in FIG. 2 there is a webbing portion 22 formed between the foot portion 10 of the bar spacer 8 and the bar gripping portion 16. The webbing 22 is, as is conventional for bar spacers, the means of maintaining the bar away from the form. In the illustrated embodiment, the web 22 is provided with reinforcing ribs 24 at its edges.

The bar spacer according to the present invention may be made from any plastics material having thequisite strength for a bar spacer. High density polyethylene has proved useful. The bar spacers may be injection molded from the high density polyethylene.

A particular advantage of the bar spacer of the present invention is that it can accommodate a wide variety of bars. For example, it is possible to produce a bar spacer able to accommodate ¼ inch to ¾ inch diameter bars having a internal diameter for the internal surface 20 of the bar gripping portion 16 of about ⅞ inch. This range of ½ inch is approximately twice the best range obtainable with the prior art devices.

I claim:

1. A bar spacer for concrete reinforcing bars comprising:

a foot portion to contact a form for concrete;

a bar gripping portion with an interior surface having two opposing groups of spaced teeth adapted to grip a reinforcing bar for concrete;

each tooth being out of alignment with each adjacent tooth in the same group, whereby each tooth can bend to a position past the adjacent tooth in the same group so that each spacer can grip and locate bars of varying diameter.

2. A bar spacer as claimed in claim 1 molded from high density polyethylene.

* * * * *